US007595589B2

(12) United States Patent
Jang et al.

(10) Patent No.: US 7,595,589 B2
(45) Date of Patent: Sep. 29, 2009

(54) PLASMA DISPLAY PANEL

(75) Inventors: Sang-Hun Jang, Suwon-si (KR); Hidekazu Hatanaka, Suwon-si (KR); Young-Mo Kim, Suwon-si (KR); Seong-Eui Lee, Suwon-si (KR); Ho-Nyeon Lee, Suwon-si (KR); Hyoung-Bin Park, Suwon-si (KR); Gi-Young Kim, Suwon-si (KR); Seung-Hyun Son, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 732 days.

(21) Appl. No.: 11/245,148

(22) Filed: Oct. 7, 2005

(65) Prior Publication Data

US 2006/0091808 A1 May 4, 2006

(30) Foreign Application Priority Data

Oct. 28, 2004 (KR) ..... 10-2004-0086538

(51) Int. Cl.
*H01J 17/49* (2006.01)

(52) U.S. Cl. ..... 313/582; 313/587; 445/24

(58) Field of Classification Search ..... 313/582–587; 345/37, 41, 60, 71; 445/24–25
See application file for complete search history.

(56) References Cited

U.S. PATENT DOCUMENTS 5,541,618 A 7/1996 Shinoda (Continued)

FOREIGN PATENT DOCUMENTS

JP S48-071967 9/1973

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Peter J Macchiarolo
*Assistant Examiner*—Donald L Raleigh
(74) *Attorney, Agent, or Firm*—Robert E. Bushnell, Esq.

(57) ABSTRACT

A plasma display that includes a lower substrate and an upper substrate arranged opposite to each other and separated by a constant distance, with a discharge space being arranged between the substrates, a plurality of partitions arranged between the lower substrate and the upper substrate that partition the discharge space into a plurality of discharge cells, a plurality of address electrodes arranged on an upper surface of the lower substrate, a first dielectric layer arranged on the upper surface of the lower substrate and covering the address electrodes, a plurality of first sustain electrodes arranged on a lower surface of the upper substrate and having the shape of a closed loop corresponding to each discharge cell, a plurality of second sustain electrodes arranged between the upper substrate and the lower substrate and having a shape of a closed loop corresponding to closed loops in the first sustain electrodes, and a phosphor layer arranged on the upper surface of the first dielectric layer and on sidewalls of the partitions.

18 Claims, 14 Drawing Sheets

U.S. PATENT DOCUMENTS

| | | | | |
|---|---|---|---|---|
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,247,987 | B1 * | 6/2001 | Moore | 445/24 |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2002/0190652 | A1 * | 12/2002 | Do et al. | 313/587 |
| 2004/0189200 | A1 * | 9/2004 | Park et al. | 313/582 |
| 2004/0212566 | A1 * | 10/2004 | Marcotte | 345/60 |

FOREIGN PATENT DOCUMENTS

| | | |
|---|---|---|
| JP | 57-050743 | 3/1982 |
| JP | 61-253745 | 11/1986 |
| JP | 03-155024 | 7/1991 |
| JP | 03-233830 | 10/1991 |
| JP | 05-041165 | 2/1993 |
| JP | 06-267430 | 9/1994 |
| JP | 08-045433 | 2/1996 |
| JP | 2845183 | 10/1998 |
| JP | 11-025868 | 1/1999 |
| JP | 2917279 | 4/1999 |
| JP | 2000-331615 | 11/2000 |
| JP | 2001-043804 | 2/2001 |
| JP | 2001-325888 | 11/2001 |

OTHER PUBLICATIONS

Office action from the Japanese Patent Office issued in Applicant's corresponding Japanese Patent Application No. 2005-304149 dated Nov. 18, 2008.

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 28 Oct. 2004 and there duly assigned Serial No. 10-2004-0086538.

BACKGROUND OF THE INVENTION

1. Field of the Invention

The present invention relates to a novel design of a plasma display panel (PDP), and more particularly, to a PDP design that results in improved brightness and luminous efficiency while allowing for a reduced address discharge voltage.

2. Description of the Related Art

A PDP is a device that produces an image via an electric discharge. PDPs are becoming popular due to its predominant display performance, such as brightness and viewing angle. A principle of the PDP is that strong AC or DC voltage is applied to two electrodes to generate gas discharge that radiates ultraviolet rays, and radiation of the ultraviolet rays excites a phosphor layer within a discharge cell to produce visible rays.

PDPs are classified into DC-type and AC-type PDPs according to a discharging manner. The DC-type PDP has a structure in which all electrodes are exposed to a discharge space and electric charges are directly moved between corresponding electrodes. The AC-type PDP has a structure in which at least one electrode is enclosed by a dielectric layer and discharge is caused by wall charge, without direct movement of electric charges between the corresponding electrodes.

Also, the PDP can be classified into facing discharge-type and surface discharge-type PDPs according to an arrangement structure of the electrodes. The facing discharge-type PDP includes pairs of sustain electrodes each positioned on upper and lower substrates, where discharge is vertically generated between the substrates. The surface discharge-type PDP includes pairs of sustain electrodes positioned on the same substrate, where discharge is generated parallel to the substrate. In spite of increased luminous efficiency, the facing discharge-type PDP has a disadvantage in that a phosphor layer is easily deteriorated by plasma. Recently, the surface discharge-type PDP has come into wide use.

However, surface discharge AC PDPs have limited performance because of their design. For example, the shape of the discharge cells limits the amount of phosphor that can be deposited within, thus limiting the amount of visible light that can be generated. When ultraviolet radiation is produced in the discharge cell, it is not uniformly transmitted to the phosphor, thus limiting brightness and luminance efficiency. Also, the address and the sustain electrodes are separated by a large distance requiring a large voltage to be applied to these electrodes to achieve the requisite address discharge. What is therefore needed is a design for a PDP that overcomes these problems.

SUMMARY OF THE INVENTION

It is therefore an object of the present invention to provide an improved design for a PDP.

It is also an object of the present invention to provide a design for a PDP that allows for more phosphor to be deposited in the discharge cells.

It is further an object of the present invention to provide a design for a PDP that produces a efficient discharge that can be uniformly transferred to the phosphor.

It is still an object of the present invention to provide a PDP where the distance between the address electrodes and the sustain electrodes is small.

It is yet an object of the present invention to provide a design for a PDP that results in improved brightness and improved luminous efficiency.

These and other objects may be achieved by a PDP that includes a lower substrate and an upper substrate arranged opposite to each other and spaced apart by a distance, with a discharge space being located between the substrates, a plurality of partitions located between the lower substrate and the upper substrate that partitions the discharge space into a plurality of discharge cells, a plurality of address electrodes located on an upper surface of the lower substrate, a first dielectric layer located on the upper surface of the lower substrate and covering the address electrodes, a plurality of first sustain electrodes having a closed loop corresponding to each discharge cell, a plurality of second sustain electrodes having a closed loop corresponding to each discharge cell while corresponding to the first sustain electrodes, and a phosphor layer located on the upper surface of the first dielectric layer and on sidewalls of the partitions.

A second dielectric layer can be located on inner sides of the first sustain electrodes, and a protective film can be located on a surface of the second dielectric layer. A protrusion made of a dielectric substance can protrude from the upper surface of the first dielectric layer into each discharge cell, and the second sustain electrode can be located on an upper surface of each protrusion. The protrusion can have a closed-loop that corresponds to a closed loop of the second sustain electrode.

A phosphor layer can be located on inner and outer walls of the protrusion, and a phosphor layer can be located at a lower surface of the upper substrate. A third dielectric layer can be located on the upper surface of the protrusion to cover the second sustain electrode, and a protective film can be located on a surface of the third dielectric layer. The first sustain electrode can have a cylindrical shape. The second sustain electrode can have a plate shape with an aperture located at a center thereof. The address electrode can have a band shape or a plate shape with an aperture located at a center thereof.

According to another aspect of the present invention, there is provided a PDP that includes a lower substrate and an upper substrate arranged opposite to each other and spaced apart by a distance, with a discharge space being located between the substrates, a plurality of partitions located between the lower substrate and the upper substrate that partitions the discharge space into a plurality of discharge cells, a plurality of address electrodes located on an upper surface of the lower substrate, a first dielectric layer located on the upper surface of the lower substrate that covers the address electrodes, a plurality of first sustain electrodes having a shape of a closed loop corresponding to each discharge cell, a second dielectric layer located on the lower surface of the upper substrate and covering the first sustain electrodes, a plurality of second sustain electrodes having a closed loop, each closed loop corresponding to each discharge cell while corresponding to the first sustain electrodes, and a phosphor layer located on the upper surface of the first dielectric layer and on sidewalls of the partitions.

The first and second sustain electrodes can have a plate shape with an aperture located at a center thereof. The address electrode can have a band shape or a plate shape with an aperture located at a center thereof. A bus electrode can be made of a non-transparent metal and can be located at an outer periphery of the first sustain electrode. The first sustain electrode can be made of indium tin oxide (ITO).

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
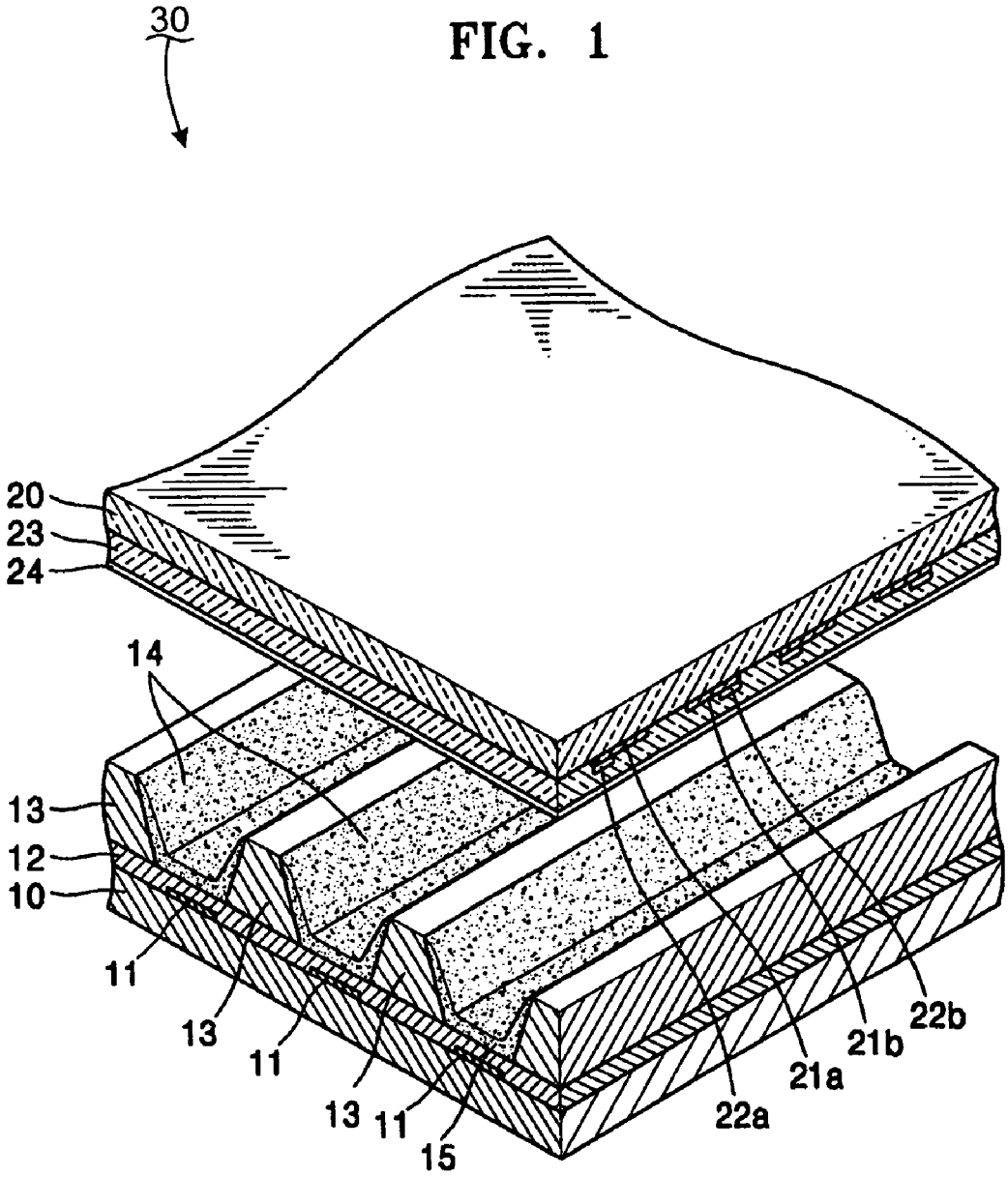
FIG. 1 is an exploded perspective view of a PDP.
Figure 2A:
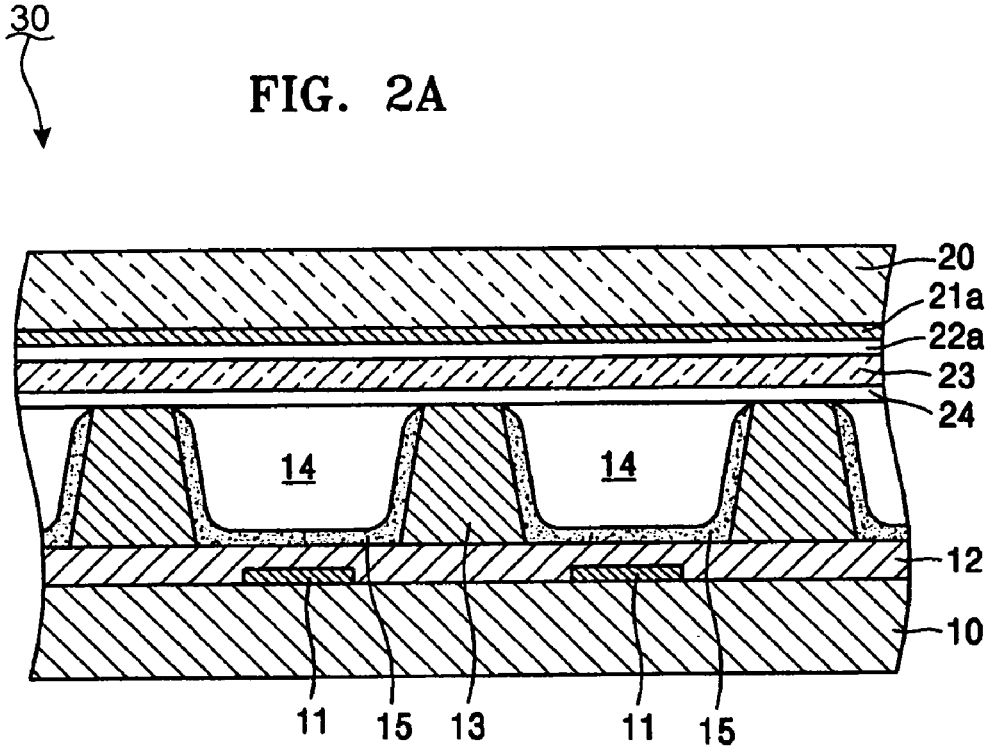
FIGS. 2A and 2B are transverse and vertical sectional views of the PDP of FIG. 1.
Figure 2B:
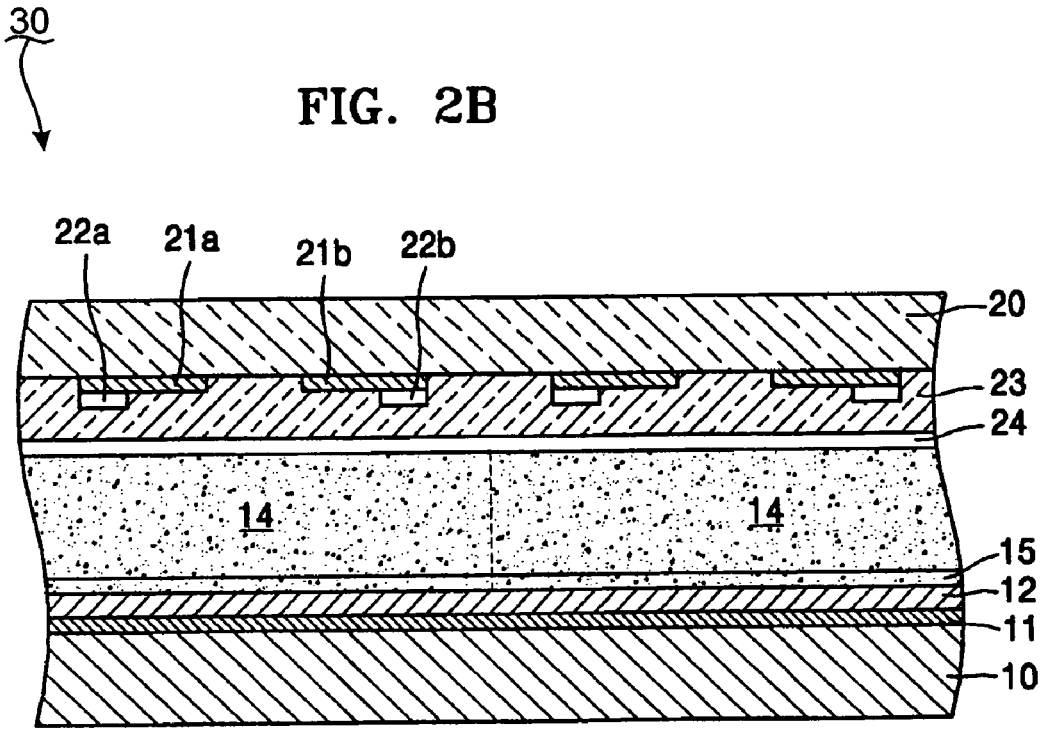

Turning now to the FIGURES, FIGS. 1, 2A and 2B illustrate a surface discharge-type PDP 30. FIGS. 2A and 2B are transverse and vertical sectional views of the PDP 30 of FIG. 1. Referring to FIGS. 1, 2A, and 2B, the PDP 30 includes an upper substrate 20 and a lower substrate 10 arranged opposite to each other and spaced apart from each other. Discharge occurs in a discharge space located between the upper substrate 20 and the lower substrate 10.

A plurality of address electrodes 11 having a stripe shape are arranged on an upper surface of the lower substrate 10. A first dielectric layer 12 covers the address electrodes 11. A discharge space between the upper substrate 20 and the lower substrate 10 is partitioned into discharge cells 14 on an upper surface of the first dielectric layer 12. A plurality of partitions 13 are located on the first dielectric layer 12 at constant intervals, so as to prevent electrical and optical interference between the discharge cells 14. A phosphor layer 15 of red R, green G and blue B is coated on an inner surface of the discharge cells 14 to a desired thickness, and the discharge cells 14 are filled with a discharge gas.

The upper substrate 20 is a transparent substrate mainly made of glass through which visible rays can transmit through. The upper substrate 20 is coupled to the lower substrate 10 with the partitions 13 located on top of the upper substrate 20. Pairs of sustain electrodes 21*a* and 21*b* are located in the shape of stripe along a direction perpendicular to the address electrodes 11 and under the upper substrate 20. The sustain electrodes 21*a* and 21*b* are made of transparent conductive material, such as indium tin oxide (ITO) allowing for visible rays to pass through. In order to reduce a line resistance along the sustain electrodes 21*a* and 21*b*, bus electrodes 22*a* and 22*b* made of metal material are located under a lower surface of each sustain electrode 21*a* and 21*b*, and have a width narrower than that of the sustain electrodes 21*a* and 21*b*. The sustain electrodes 21*a* and 21*b* and the bus electrodes 22*a* and 22*b* are covered by a second dielectric layer 23. A protective layer 24 is formed over the second dielectric layer 23 and is generally made of MgO. Protective layer 24 serves to prevent the second dielectric layer 23 from being sputtered by plasma particles. Protective layer 24 also serves to lower a discharge voltage by emitting secondary electrons.

The PDP 30 configured as described is limited in the amount of phosphor material that can be deposited in the discharge cells. In addition, there is a problem in that since the ultraviolet rays produced in the discharge cell can not be uniformly transmitted to the phosphor layer, thus limiting brightness and luminous efficiency of the PDP 30. Also, there is another problem in that since the distance between the address electrode and the sustain electrode is relatively large, the voltage applied to the address electrode must be high to achieve an address discharge.

Figure 3:
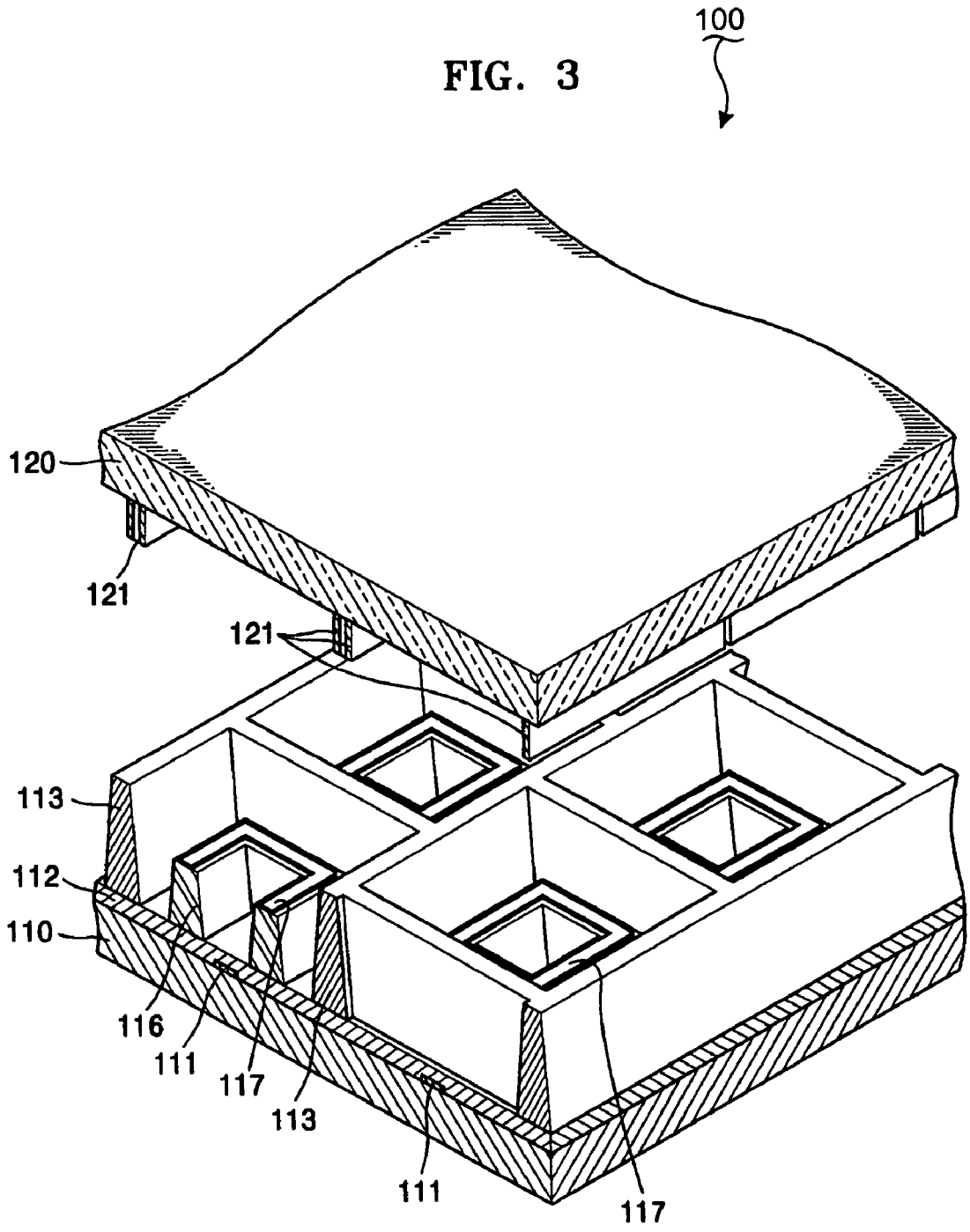
FIG. 3 is an exploded perspective view of a PDP according to a first embodiment of the present invention.
Figure 4:
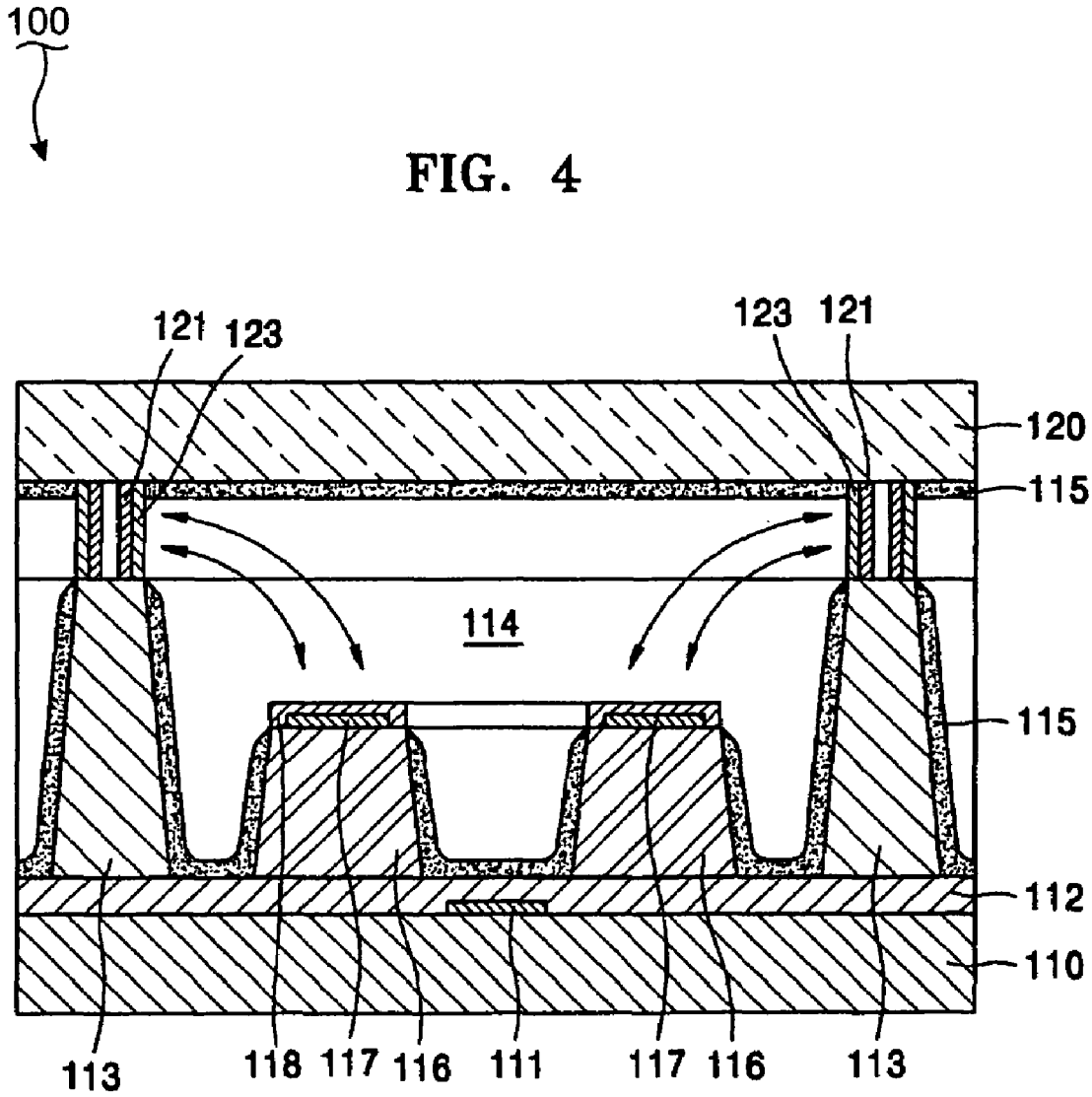
FIG. 4 is a cross-sectional view of the PDP of FIG. 3.
Figure 5:
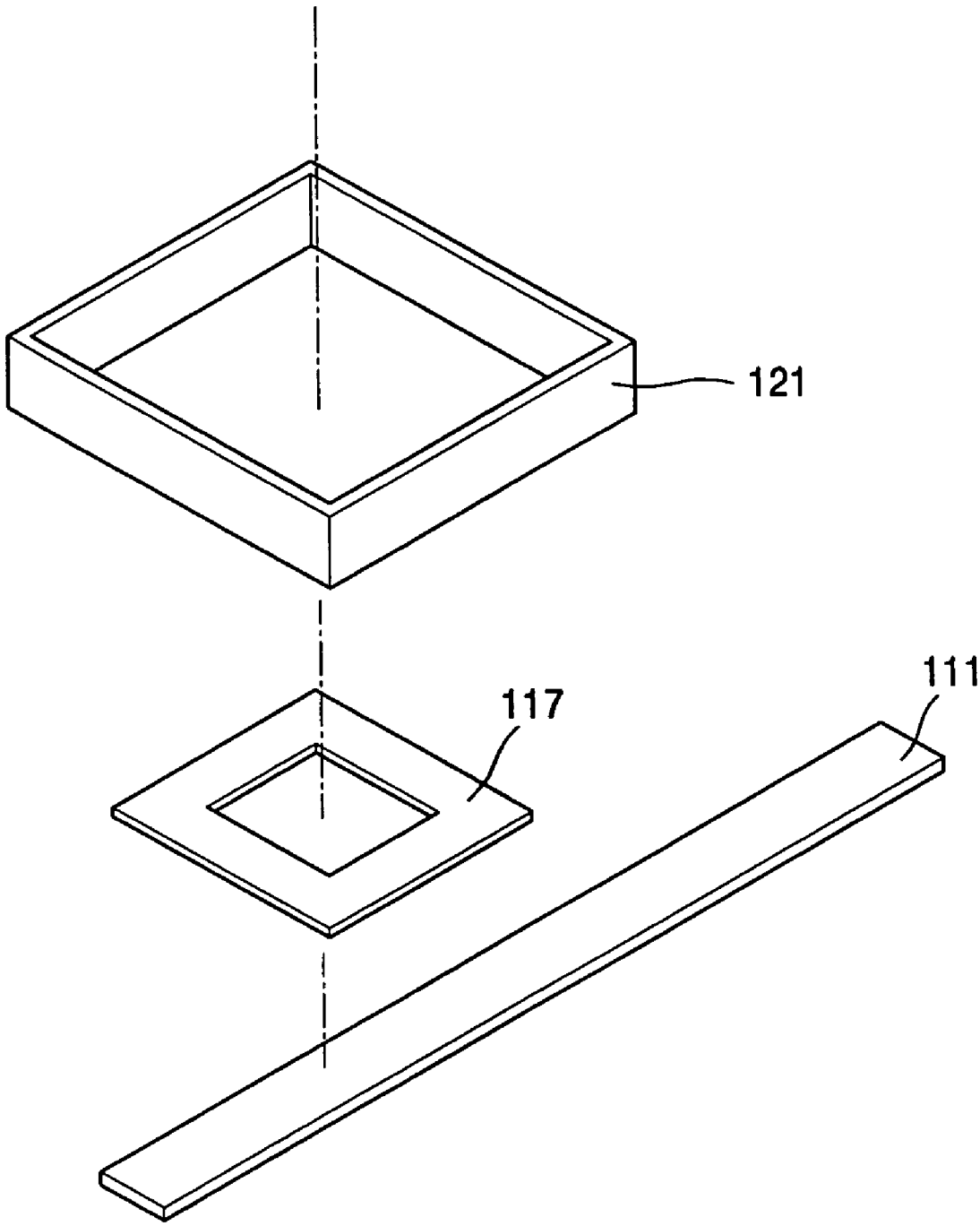
FIG. 5 is a perspective view depicting the electrodes in the PDP of FIG. 3.

Turning now to FIGS. 3 through 5, FIG. 3 is an exploded perspective view of a PDP 100 according to a first embodiment of the present invention, FIG. 4 is a cross-sectional view of the PDP 100 of FIG. 3 and FIG. 5 is a perspective view depicting electrodes employed in the PDP 100 of FIG. 3. For the sake of clarity, a second dielectric layer 123, a phosphor layer 115, and a line connecting the electrodes are not illustrated in FIG. 3 even though these features are part of the design of PDP 100.

Referring to FIGS. 3 through 5, a lower substrate 110 and an upper substrate 120 are arranged opposite to each and spaced apart by a certain distance. A discharge space is located between the lower substrate 110 and the upper substrate 120. The lower substrate 110 and the upper substrate 120 are generally made of glass.

A plurality of address electrodes 111 are located on an upper surface of the lower substrate 110. The address electrodes 111 can have the shape of a band (or stripe) as illustrated of FIG. 5. Alternatively, an address electrode 111' can have a rectangular plate shape with an aperture located at the center thereof, as illustrated of FIG. 6. The address electrodes 111 are covered by a first dielectric layer 112 located on the upper surface of the lower substrate 110.

A plurality of partitions 113 are located on an upper surface of the first dielectric layer 112 and are formed to have a desired height to partition the discharge space between the lower substrate 110 and the upper substrate 120 into a plurality of discharge cells 114. The partitions 113 serve to prevent electrical and optical interference between neighboring discharge cells 114.

A plurality of first sustain electrodes 121 are sandwiched between the upper surfaces of the partitions 113 and the lower surface of the upper substrate 120. The first sustain electrodes 121 form closed loops above the upper surfaces of the partitions 113, each closed loop corresponding to a discharge cell 114. Dielectric substance is interposed between the first sustain electrodes 121. The first sustain electrode 121 can be have a rectangular case shape electrode, as illustrated of FIG. 5.

A second dielectric layer 123 is located between the upper surface of the partitions 113 and the lower surface of the upper substrate 120. The second dielectric layer 123 also covers inner surfaces of the first dielectric electrodes 121. A protective film (not illustrated) covers the second dielectric layer 123 to prevent the second dielectric layer 123 from being exposed to and damaged by plasma particles. This protective film that covers second dielectric layer 123 also allows for application of a lower discharge voltage by emitting secondary electrons. Preferably, the protective film is made of MgO.

A protrusion 116 made of a dielectric material extends to a desired height from the upper surface of the first dielectric layer 112. The protrusion 116 can be have a closed loop shape, and a second sustain electrode 117 of a closed loop corresponding to the first sustain electrode 121 is located on an upper surface of the protrusion 116. Alternatively, the protrusion 116 can be omitted and the second sustain electrode 117 can be located directly on the upper surface of the first dielectric layer 112 and still be within the scope of the present invention.

The second sustain electrode 117 can have a rectangular plate shape with an aperture located at the center thereof, as illustrated of FIG. 5. A third dielectric layer 118 is located on the upper surface of the protrusion 116 to cover the second sustain electrode 117. A protective film (not illustrated) can be located on top of the third dielectric layer 118.

A phosphor layer 115 is located on the upper surface of the first dielectric layer 112 and on sidewalls of partitions 113 used to form an inner wall of the discharge cells 114. The phosphor layer 115 can also be located on inner and outer walls of the protrusion 116. Further, phosphor layer 115 can be located at a lower surface of the upper substrate 120. As a result, there is much more surface area for phosphor material to be deposited on for each discharge cell 114 of PDP 100 than in the PDP 30 of FIGS. 1, 2A and 2B Turning now to FIG. 7, FIG. 7 is a perspective view depicting electrodes of a different shape that can be employed in a PDP 100 according to a variation of the first embodiment of the present invention. Referring to FIG. 7, a first sustain electrode 121' can have a cylindrical shape instead of the rectangular case shape of FIGS. 5 and 6. Second sustain electrode 117' can have a disk shape instead of the rectangular plate shape of FIGS. 5 and 6. The address electrode 111 can have a band shape. Meanwhile, as illustrated of FIG. 8, the address electrode 111" can have a disk shape having an aperture located at the center thereof.

Although the variations of the first embodiment show the first sustain electrode as having either a rectangular case shape or a cylindrical shape, in no way is the present invention so limited to these designs. Likewise, the second sustain electrode can also have other various shapes of a plate with an aperture located at the center thereof, besides the rectangular plate shape electrode 117 or the disk shape electrode 117'. Similarly, the address electrode can also have other various shapes of a plate with an aperture located at the center thereof instead of the band shape electrode 111, the rectangular plate shape electrode 111' and the disk shape electrode 111".

With the PDP 100 configured as described above, a sustain discharge is generated between the first sustain electrode 121 or 121' and the second sustain electrode 117 or 117'. With the designs of FIGS. 3 through 8 according to the first embodiment of the present invention, since the first sustain electrodes 121 and 121' have a case or a cylindrical shape, and the second sustain electrodes 117 and 117' have a plate shape with an aperture located at the center thereof, the characterization of the sustain discharge is a combination of both the facing type and the surface type. As a result, ultraviolet rays produced by this hybrid type discharge uniformly transmits to the phosphor layer 115 located on the inner wall of the discharge cell 114, resulting in improved brightness and improved luminous efficiency over the PDP 30 design of FIGS. 1, 2A and 2B.

Also, with the designs of FIGS. 3 through 8 according to the first embodiment of the present invention, the address discharge is generated between the address electrode 111, 111' or 111" and the second sustain electrode 117 or 117' of a pair of sustain electrodes. When the address electrode takes on a band shape as in FIGS. 5 and 7, the address discharge is generated between the center region of the second sustain electrode 117 or 117' and the address electrode 111. When the address electrodes have a plate-like shape as in FIGS. 6 and 8, the address discharge is generated in the same shape as that of the second sustain electrode 117 or 117' and the address electrode 111' or 111". In either case, the distance between the address electrode 111, 111' or 111" and the second sustain electrode 117 or 117' in the PDPs according to the first embodiment of the present invention is smaller than that of PDP 30 of FIGS. 1, 2A and 2B. By decreasing this distance between the address electrode and the second sustain electrode, an address discharge can occur with less applied voltage than in the case of the PDP 30 of FIGS. 1, 2A and 2B. Also, reset discharge can be generated between the address electrode 111, 111' or 111" and the second sustain electrode 117 or 117', which can improve contrast.

In the PDP 100 of FIGS. 3 through 8, since the phosphor layer 115 can be located on the inner and outer walls of the protrusion 116, on the lower surface of the upper substrate 120, on the upper surface of the first dielectric layer 112 and on the side of the partitions 113, more phosphor material can be placed inside each discharge cell 114 compared to the PDP 30 of FIGS. 1, 2A and 2B. This increase in the amount of phosphor material in each discharge cell results in an increase in the amount of visible rays produced during a discharge. Another benefit of the PDP according to the first embodiment is that a larger percentage of visible light produced can be actually viewed. This improvement in luminance efficiency is brought about by having no dielectric layer formed on the upper substrate 120, allowing for a larger percentage of visible rays produced within the discharge cells 114 to transmit through the upper substrate 120 where they can be viewed without having to go through a separate dielectric layer.

Figure 6:
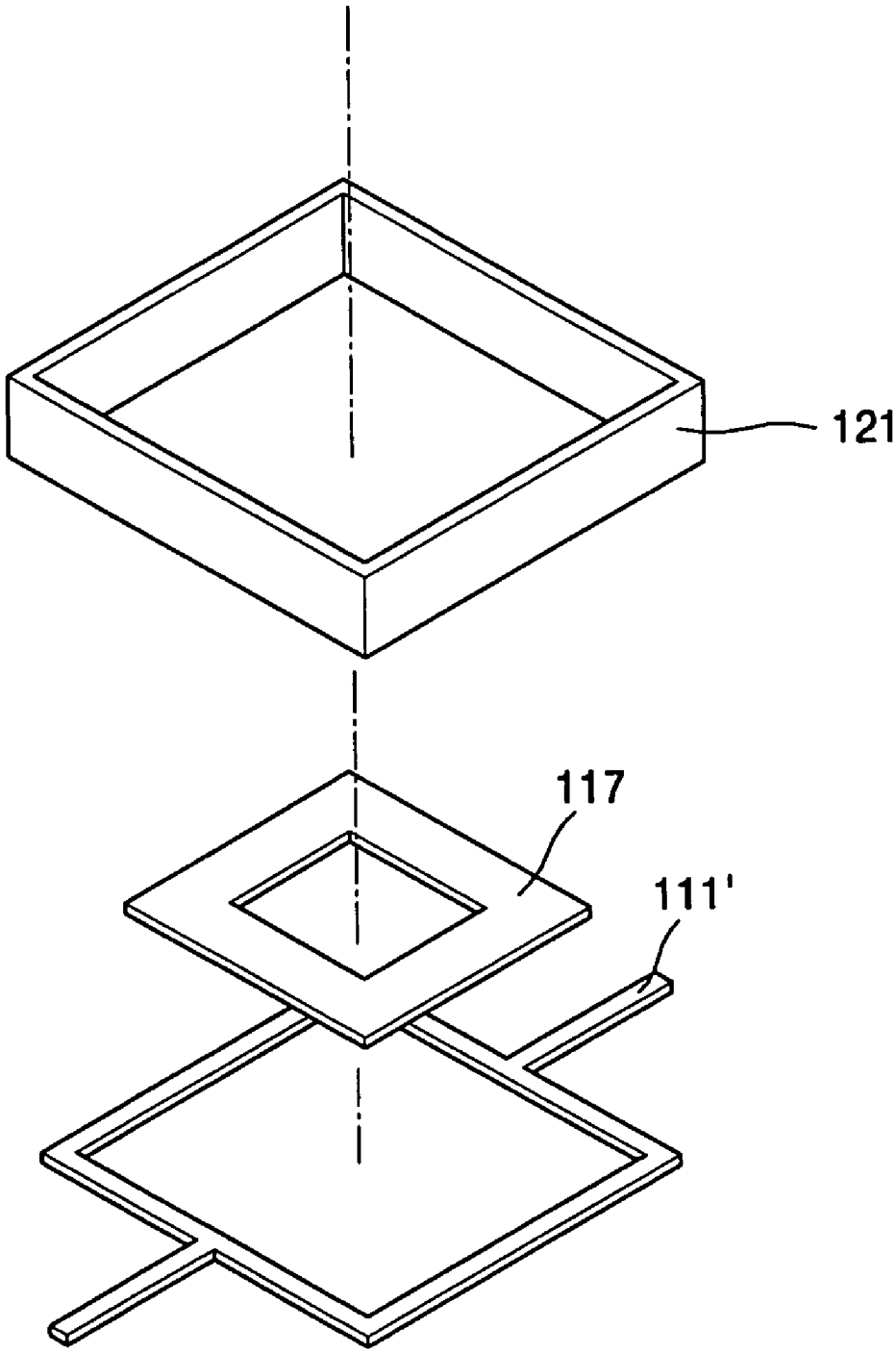
FIG. 6 is a perspective view depicting a variation of electrode design that can be used in the PDP of FIG. 3.
Figure 7:
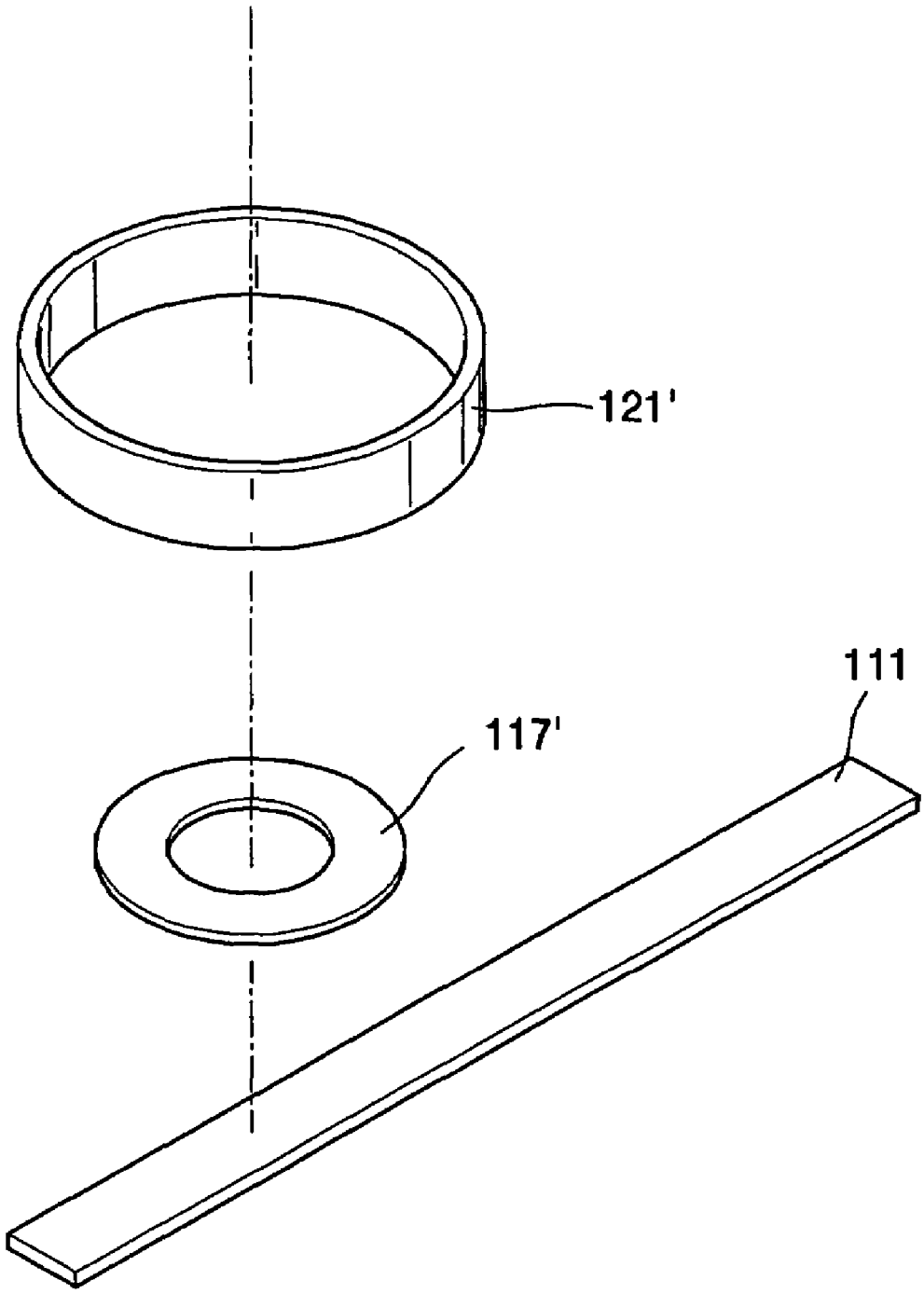
FIG. 7 is a perspective view depicting another variation of electrode design that can be used in the PDP of FIG. 3.
Figure 8:
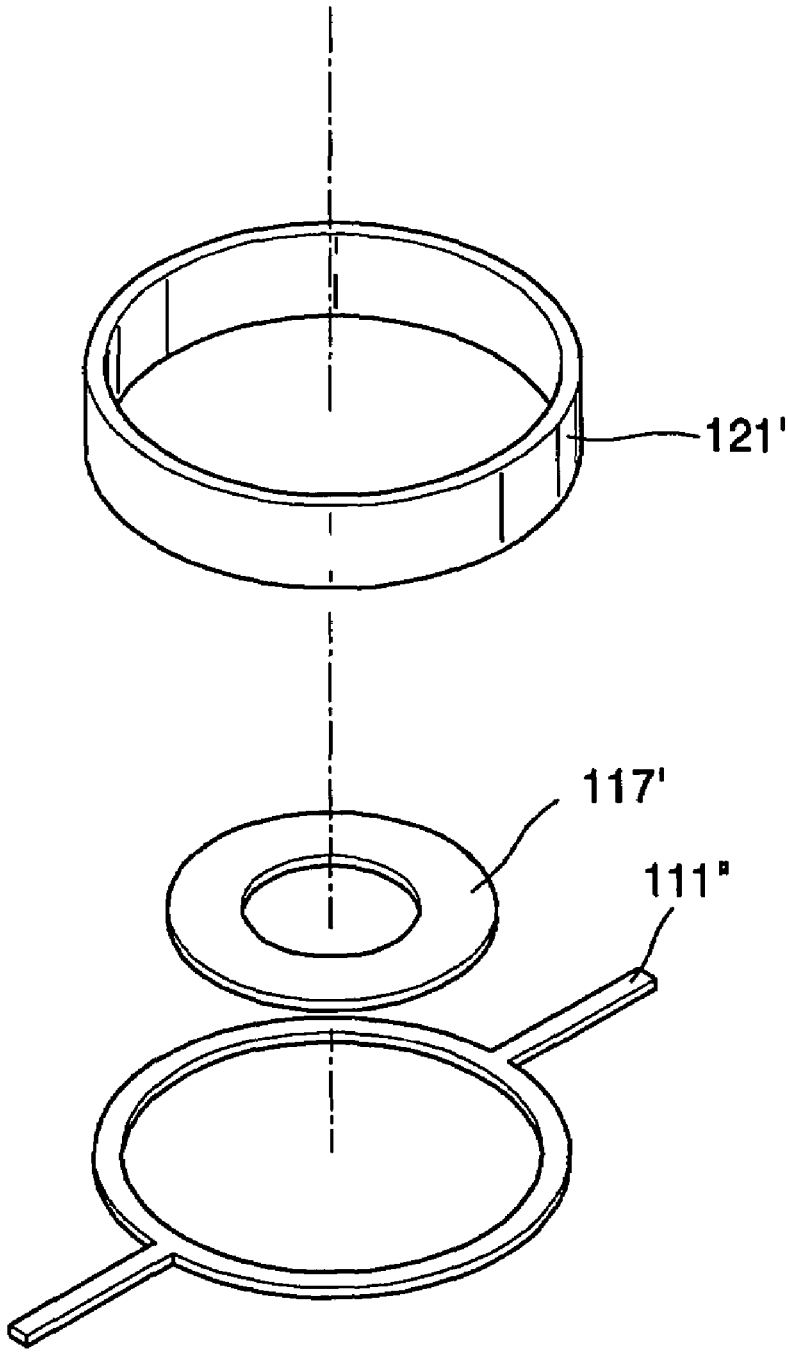
FIG. 8 is a perspective view depicting yet another variation of electrode design that can be used in the PDP of FIG. 3.

Comparing the PDP 100 of FIGS. 3 through 5 and variations thereof in FIGS. 6 through 8 according to the first embodiment of the present invention with the PDP 30 of FIGS. 1, 2A and 2B, the luminous efficiency of the present PDP 100 is improved by about 38% compared to that of PDP 30. Also, the discharge start voltage of the present PDP 100 is lowered by about 32% compared to that of PDP 30.

Figure 9:
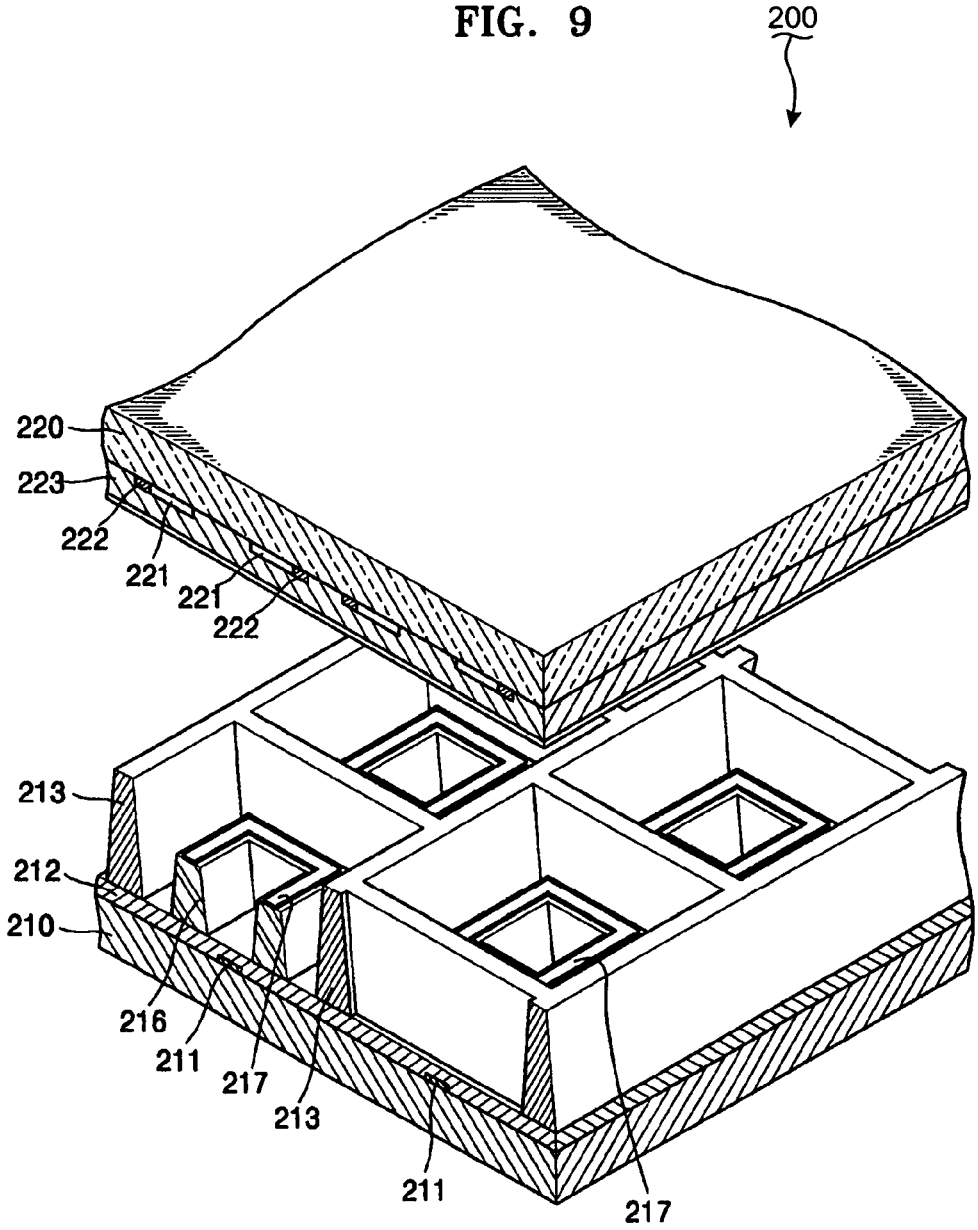
FIG. 9 is an exploded perspective view of a PDP according to a second embodiment of the present invention.
Figure 10:
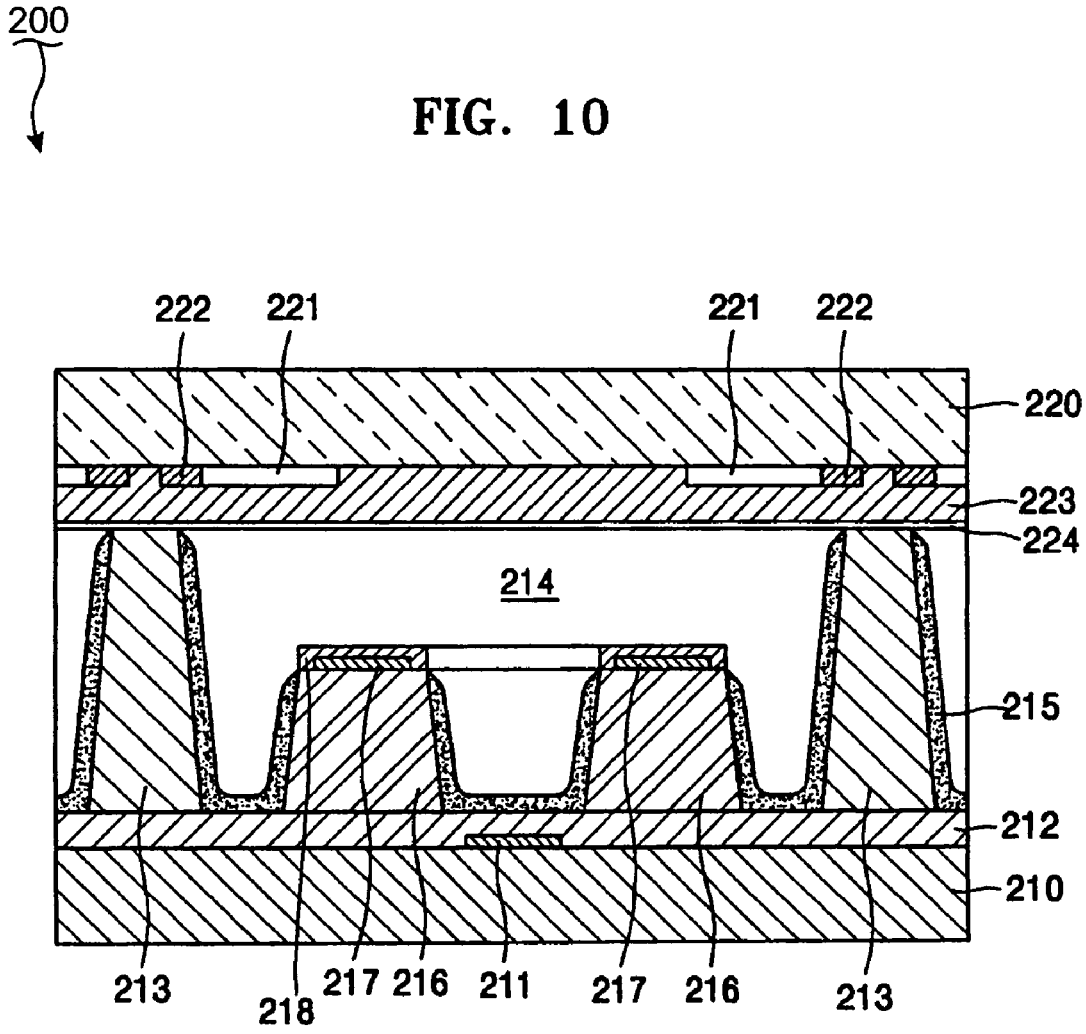
FIG. 10 is a cross-sectional view of the PDP of FIG. 9.
Figure 11:
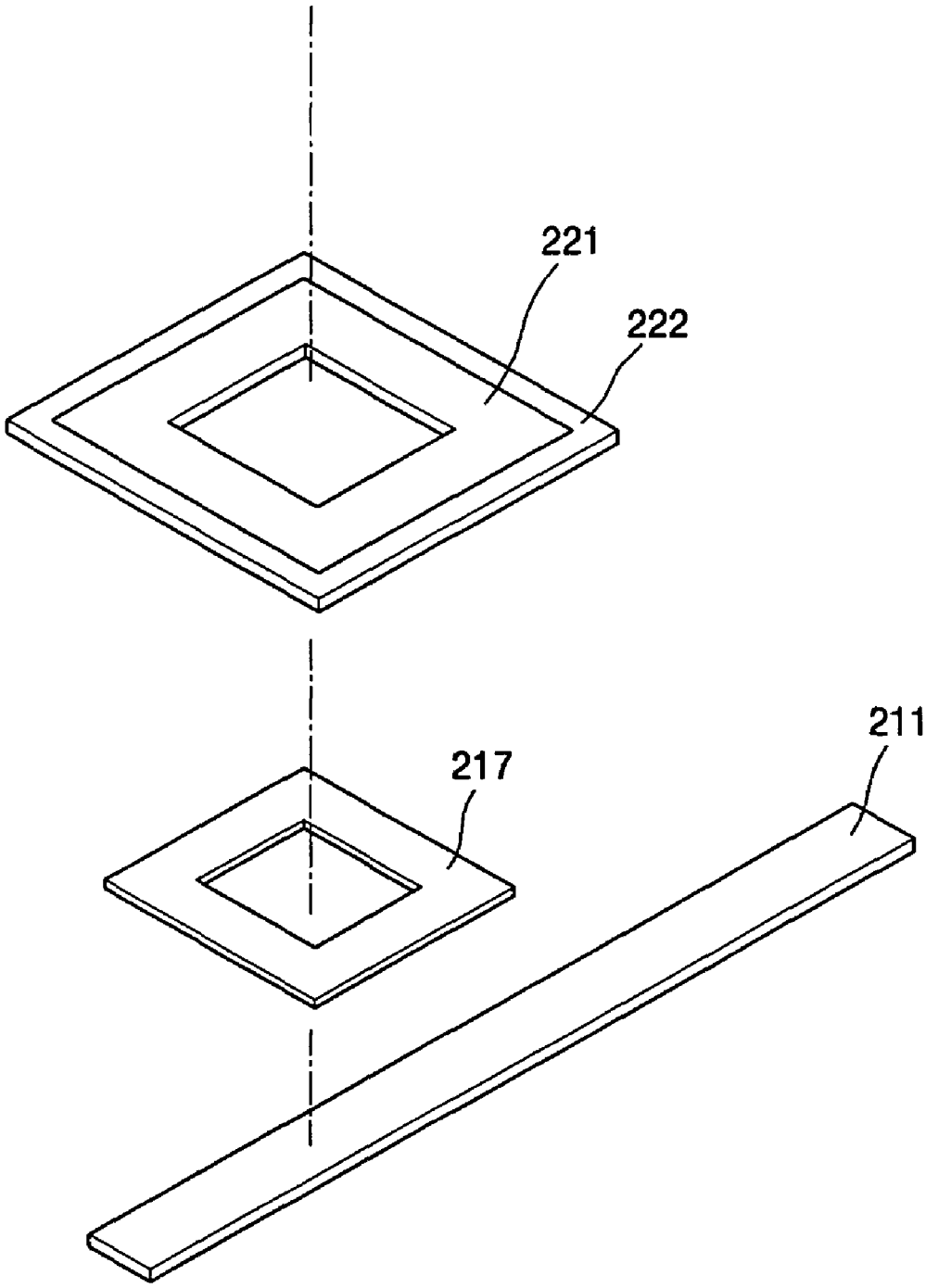
FIG. 11 is a perspective view depicting the electrodes in the PDP of FIG. 9.

Turning now to FIGS. 9 through 11, FIGS. 9 through 11 illustrate views of PDP 200 according to a second embodiment of the present invention, where FIG. 9 is an exploded view of PDP 200, FIG. 10 is a cross sectional view of PDP 200 and FIG. 11 is a perspective view of the electrodes used in PDP 200 of FIGS. 9 and 10.

Figure 12:
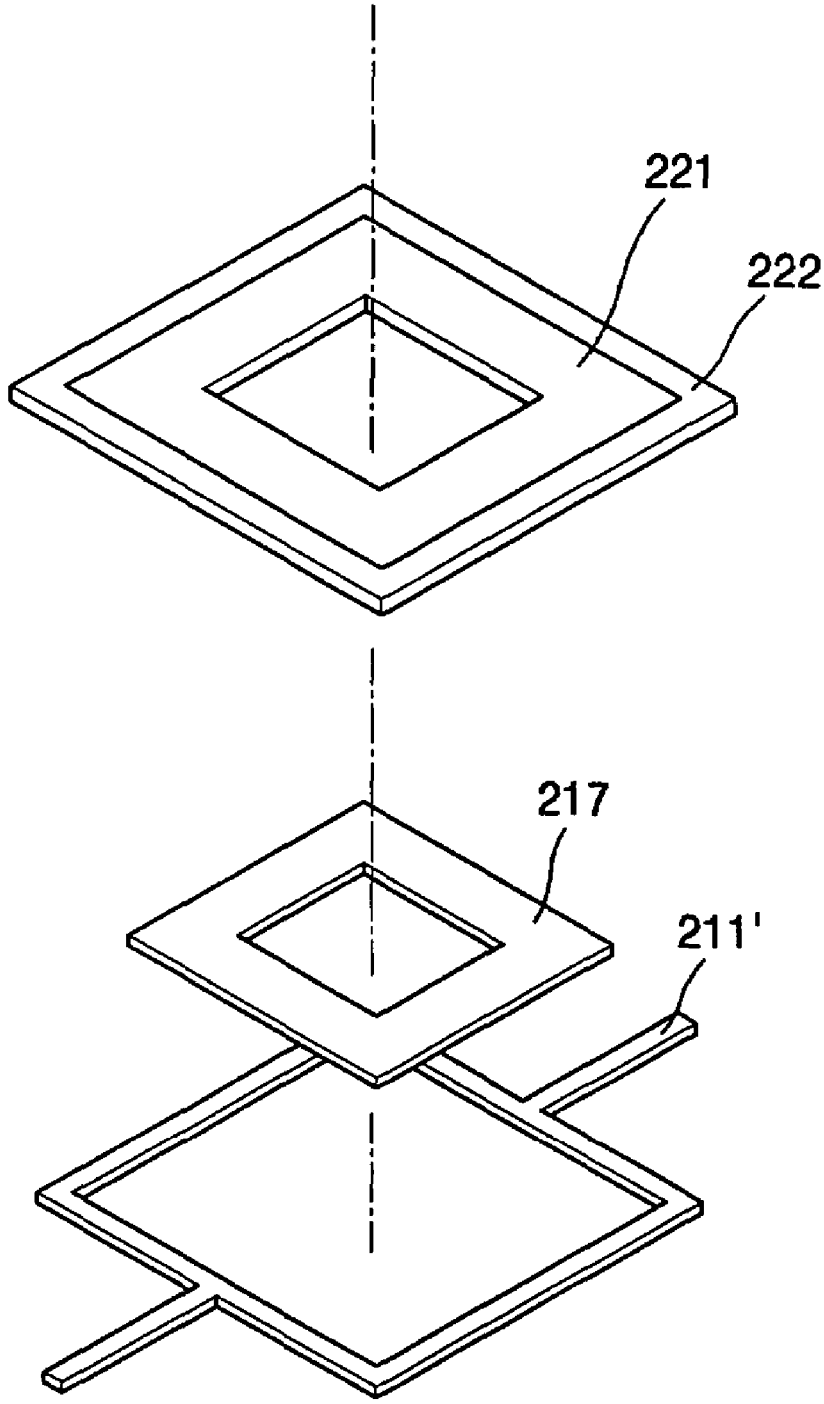
FIG. 12 is a perspective view depicting a variation of electrode design that can be used in the PDP of FIG. 9.

Referring to FIGS. 9 through 11, a lower substrate 210 and an upper substrate 220 are arranged opposite to each other and separated from each other by a certain distance. A discharge space is located between the lower substrate 210 and the upper substrate 220. A plurality of address electrodes 211 are located on an upper surface of the lower substrate 210, and a first dielectric layer 212 is formed over the address electrodes 211 to cover the address electrodes 211. The address electrodes 211 can have the shape of a band, as illustrated of FIG. 11. Alternatively, an address electrode 211' can have a rectangular plate shape having an aperture located at the center thereof, as illustrated of FIG. 12. A plurality of partitions 213 are located on an upper surface of the first dielectric layer 212 to partition the discharge space between the two substrates into a plurality of discharge cells 214.

A plurality of first sustain electrodes 221 are located on a lower surface of the upper substrate 220. The first sustain electrodes 221 is formed to have the shape of a closed loop and are formed on top of an upper surface of the partitions 213, each closed loop corresponding to a different discharge cell 214. The first sustain electrodes 221 can have a rectangular plate shape with an aperture located at the center thereof, as illustrated of FIG. 11. The first sustain electrode 221 can be made of indium tin oxide (ITO), which is a transparent conductive material. A plurality of bus electrodes 222 made of an opaque, highly conductive metal can be located at an outside edge of the first sustain electrode 221 to reduce a line resistance of the first sustain electrode 221 that is made of a lesser conductive but transparent ITO.

A second dielectric layer 223 is formed on the lower surface of the upper substrate 220 and covers both the first sustain electrodes 221 and the bus electrodes 222. Preferably, the second dielectric layer 223 is made of transparent material to allow visible rays generated in the discharge cells to pass through and be viewed by a viewer on the outside. A protective film 224 can be formed over the second dielectric layer 223 to prevent the second dielectric layer 223 from being sputtered and thus damaged by plasma particles. Protective film 224 also serves to reduce a discharge voltage by emitting secondary electrons. Preferably, the protective film 224 is made of MgO.

A protrusion 216 made of dielectric material extends to a desired height in each discharge cell 214 from the upper surface of the first dielectric layer 212. The protrusion 216 can have the shape of a closed loop, and a second sustain electrode 217 can be formed on top of the protrusion and thus also have the shape of a closed loop that corresponds to the closed loops of the first sustain electrode 221. Alternatively, the second sustain electrode 217 can be formed directly on the first dielectric layer 212. In such a scenario, no protrusion 216 is formed on the first dielectric layer 212. This is to say, the second sustain electrodes are arranged between the upper substrate 220 and the lower substrate 210.

The second sustain electrode 217 can have the shape of a rectangular plate with an aperture located at the center thereof, as illustrated of FIG. 11. A third dielectric layer 218 can be formed on the upper surface of the protrusion 216 to cover the second sustain electrode 217. A protective film (not illustrated) can be further be formed to cover the third dielectric layer 218.

In the second embodiment of the present invention, a phosphor layer 215 can be located on the upper surface of the first dielectric layer 212 and on sidewalls of the partitions 213 that forms an inner walls of the discharge cells 214. The phosphor layer 215 can also be located on inner and outer walls of the protrusions 216, allowing for more surface area and thus more phosphor material to be deposited in each discharge cell 214 than in the PDP 30 of FIGS. 1, 2A and 2B.

Figure 13:
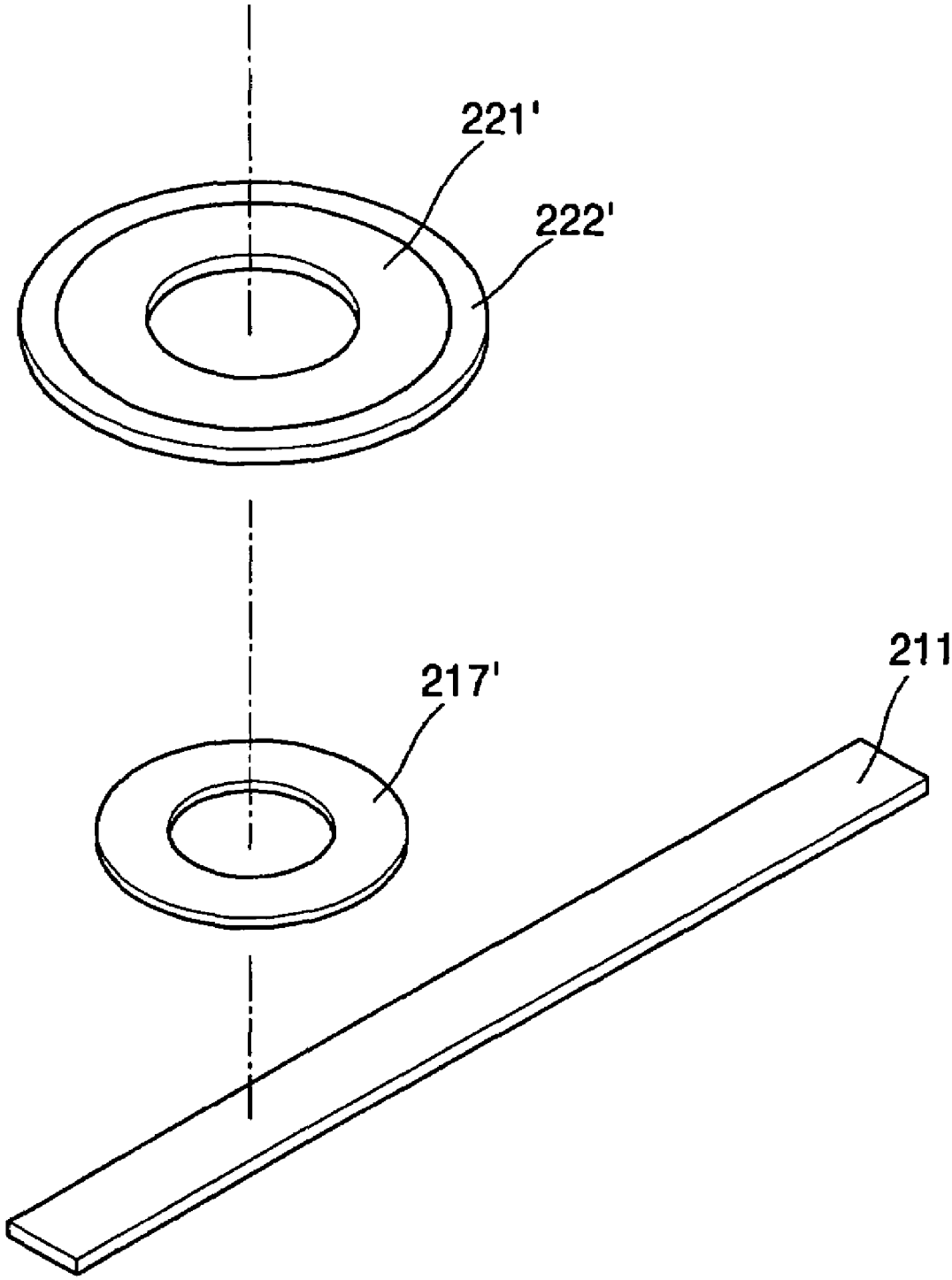
FIG. 13 is a perspective view depicting another variation of electrode design that can be used in the PDP of FIG. 9.
Figure 14:
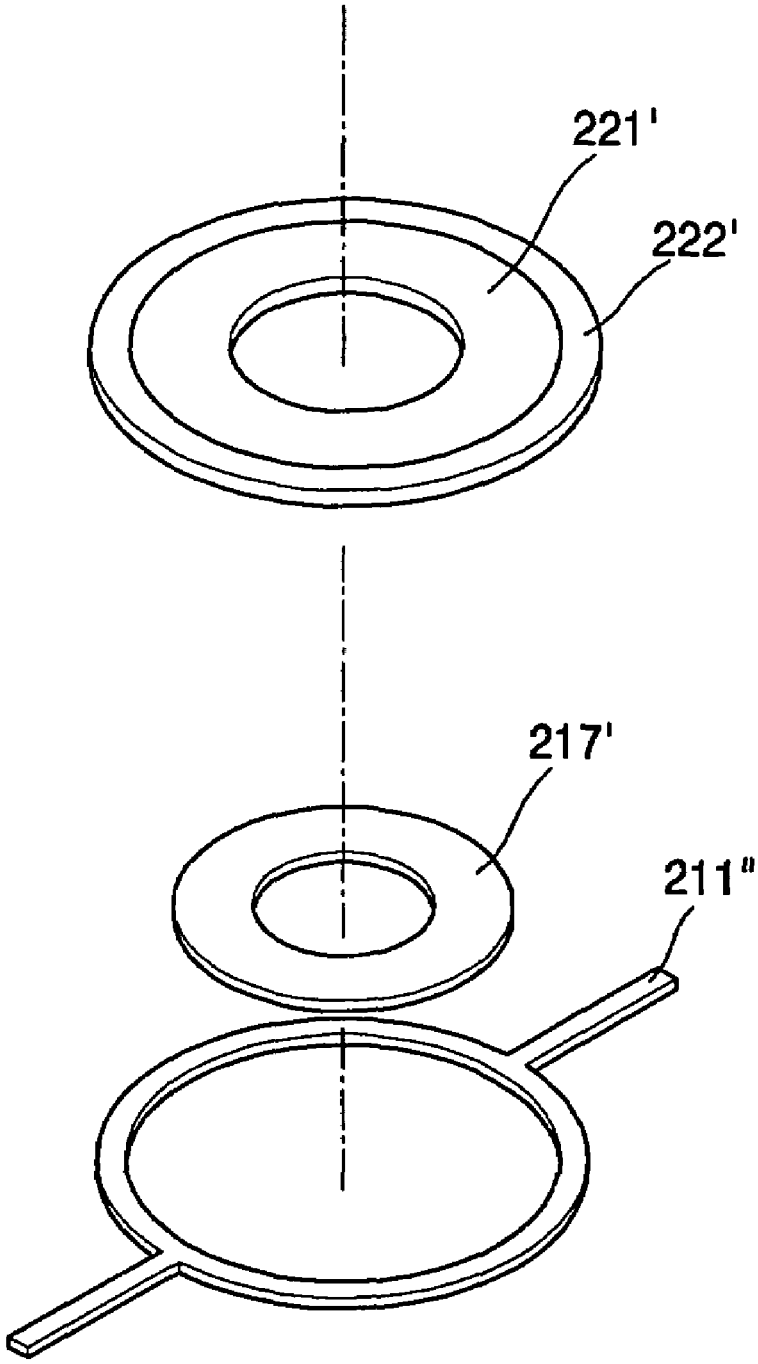
FIG. 14 is a perspective view depicting yet another variation of electrode design that can be used in the PDP of FIG. 9.

Turning now to FIG. 13, FIG. 13 is a perspective view depicting a variation in design of the shape of the electrodes that can be used in the PDP 200 of FIG. 9 according to the present invention. Referring to FIG. 13, a first sustain electrode 221' has a disk shape with an aperture located at the center thereof. With the configuration of FIG. 13, a bus electrode 222' can be located at an outer periphery of the first sustain electrode 221'. A second sustain electrode 217' also has a disk shape with an aperture located at the center thereof. The address electrode 211 can have a band shape. However, in another variant as illustrated of FIG. 14, the address electrode 211" can instead have a disk shape with an aperture located at the center thereof.

Although the first sustain electrode is described as having either a rectangular plate shape or a disk shape, the present invention is in no way so limited, as the first sustain electrode can have other shapes and still be within the scope of the present invention. Likewise, although the present invention describes the second sustain electrode as having either a rectangular plate shape or a disk shape, the present invention is in no way so limited, as the first sustain electrode can have other shapes and still be within the scope of the present invention. Again likewise, although the present invention describes the address electrode as having either a band shape, a rectangular plate shape or a disk shape, the present invention is in no way so limited as the address electrode can have other shapes and still be within the scope of the present invention.

With the PDP 200 configured as described above, a sustain discharge is generated between the first sustain electrode 221 or 221' and the second sustain electrode 217 or 217'. Because the sustain discharge is generated in a surface-type manner for this second embodiment, luminous efficiency is improved. With the PDP 200 as designed according to this second embodiment, the address discharge voltage can be lowered, and more phosphor material can be placed within each discharge cell 214.

In conclusion, the PDPs according to the present invention have the following beneficial effects. First, since a sustain discharge is generated between the first and second sustain electrodes in either a mixed facing and surface discharge manner or in just a surface-type discharge manner, the ultraviolet radiation generated by these discharges uniformly transmits to the phosphor layer located on the inner wall of the discharge cell, which leads to improved brightness and improved luminous efficiency. Second, since a distance between the address electrode and the second sustain electrode in the embodiments of the present invention is smaller than that of PDP 30 of FIGS. 1, 2A and 2B, the address discharge voltage can be lowered. Also, reset discharge is also generated between the address electrode and the second sustain electrode, which can improve contrast. Finally, since more phosphor material can be arranged inside each discharge cell in the embodiment of the present invention as opposed to the PDP 30 of FIGS. 1, 2A and 2B, more visible rays are generated.

While the present invention has been particularly illustrated and described with reference to exemplary embodiments depicted in the drawings, it will be understood by those of ordinary skill in the art that various changes and modifications in form and details can be made therein without departing from the spirit and scope of the present invention.

What is claimed is:

1. A plasma display panel (PDP), comprising:

a lower substrate and an upper substrate arranged opposite to each other and spaced apart from each other, a discharge space being arranged between the lower substrate and the upper substrate;

a plurality of partitions arranged between the lower substrate and the upper substrate, the partitions adapted to partition the discharge space into a plurality of discharge cells;

a plurality of address electrodes arranged on an upper surface of the lower substrate;

a first dielectric layer covering the plurality of address electrodes;

a plurality of first sustain electrodes arranged between the upper substrate and the lower substrate, the first sustain electrodes including closed loops, each closed loop corresponding to individual discharge cells;

a plurality of second sustain electrodes arranged between the upper substrate and the lower substrate and including closed loops, each closed loop corresponding to closed loops of the first sustain electrodes;

a phosphor layer arranged on an upper surface of the first dielectric layer and on sidewalls of the partitions; and a protrusion of a dielectric material extending from the upper surface of the first dielectric layer into each of the plurality of discharge cells, the second sustain electrodes being arranged on upper surfaces of each protrusion.

2. The PDP of claim 1, further comprising:

a second dielectric layer arranged on inner sides of the first sustain electrodes; and a protective film arranged over the second dielectric layer.

3. The PDP of claim 1, the protrusion being arranged as a closed-loop, each closed loop corresponding to a closed loop of the second sustain electrodes.

4. The PDP of claim 3, the phosphor layer also being arranged on both inner and outer walls of the protrusion.

5. The PDP of claim 4, the phosphor layer also being arranged on a lower surface of the upper substrate.

6. The PDP of claim 3, further comprising:

a third dielectric layer arranged on the upper surface of the protrusion and covering the second sustain electrodes; and a protective film arranged over the third dielectric layer.

7. The PDP of claim 1, the first sustain electrode having a cylindrical shape.

8. The PDP of claim 7, the second sustain electrode having a plate shape and having an aperture arranged at a center thereof.

9. The PDP of claim 8, the address electrode comprising a shape selected from a group consisting of a band shape and a plate shape having an aperture arranged at a center thereof.

10. A plasma display panel (PDP), comprising:

a lower substrate and an upper substrate arranged opposite to each other and spaced apart from each other, a discharge space being arranged between the lower substrate and the upper substrate;

a plurality of partitions arranged between the lower substrate and the upper substrate, the partitions adapted to partition the discharge space into a plurality of discharge cells;

a plurality of address electrodes arranged on an upper surface of the lower substrate;

a first dielectric layer covering the plurality of address electrodes;

a plurality of first sustain electrodes arranged between the upper substrate and the lower substrate and including closed loops, each closed loop corresponding to an individual discharge cells;

a second dielectric layer arranged on the lower surface of the upper substrate and covering the first sustain electrodes;

a plurality of second sustain electrodes arranged between the upper substrate and the lower substrate and comprising closed loops corresponding to the closed loops of the first sustain electrodes;

a phosphor layer arranged on an upper surface of the first dielectric layer and on sidewalls of the partitions; and a protrusion of a dielectric material extending from the upper surface of the first dielectric layer and into each discharge cell, the second sustain electrodes being arranged on upper surfaces of each protrusion.

11. The PDP of claim 10, further comprising a protective film arranged over the second dielectric layer.

12. The PDP of claim 10, the protrusion being arranged as a closed-loop, each closed loop corresponding to a closed loop of the second sustain electrodes.

13. The PDP of claim 12, the phosphor layer also being arranged on both inner and outer walls of the protrusion.

14. The PDP of claim 12, further comprising:

a third dielectric layer arranged on the upper surface of the protrusion and covering the second sustain electrodes; and a protective film arranged over the third dielectric layer.

15. The PDP of claim 10, the first and second sustain electrodes each having a plate shape and each having an aperture arranged at a center thereof.

16. The PDP of claim 15, the address electrode comprising a shape selected from a group consisting of a band shape and a plate shape having an aperture arranged at a center thereof.

17. The PDP of claim 10, further comprising a metal bus electrode arranged at an outer periphery of each first sustain electrode.

18. The PDP of claim 17, the first sustain electrodes each comprise Indium Tin Oxide (ITO).

* * * * *